US006199475B1

(12) United States Patent
Schwelling

(10) Patent No.: US 6,199,475 B1
(45) Date of Patent: Mar. 13, 2001

(54) DRIVE AND BEARING DEVICE FOR THE TWISTING DISKS OF THE BINDING DEVICE OF A WASTE BALE PRESS

(76) Inventor: Hermann Schwelling, Hartmannweg 5, D-88682 Salem (DE)

( * ) Notice: Subject to any disclaimer, the term of this patent is extended or adjusted under 35 U.S.C. 154(b) by 0 days.

(21) Appl. No.: 09/259,032

(22) Filed: Feb. 26, 1999

(30) Foreign Application Priority Data

Feb. 28, 1998 (DE) ..... 198 08 416

(51) Int. Cl.[7] ..... B65B 13/28

(52) U.S. Cl. ..... 100/31; 100/11; 100/19 R; 100/29; 100/32; 100/20; 140/93.6; 140/93 R; 74/465

(58) Field of Search ..... 100/11, 19 R, 100/20, 21, 29, 30, 31, 32; 140/93.6, 93 R; 74/421 R, 465

(56) References Cited

U.S. PATENT DOCUMENTS

| | | | | |
|---|---|---|---|---|
| 860,536 | * | 7/1907 | Ellingham | 74/465 |
| 1,040,278 | * | 1/1912 | Collins | 100/20 |
| 4,459,904 | * | 7/1984 | Probst et al. | 100/11 |

FOREIGN PATENT DOCUMENTS

| | | |
|---|---|---|
| 2656457 | 6/1978 | (DE) . |
| 3544773 | 11/1990 | (DE) . |

* cited by examiner

*Primary Examiner*—Peter Vo
*Assistant Examiner*—Louis K. Huynh
(74) *Attorney, Agent, or Firm*—Friedrich Kueffner

(57) ABSTRACT

A drive and bearing device for a binding station for finished bales predominantly in waste bale presses with a horizontally acting press plate, wherein several twisting wheels provided with a radial slot for receiving the binding wire are mounted in a support and are temporarily rotated by a common drive unit for the purpose of twisting the wire. The wheels supporting the slotted twisting disks have a plurality of arms or bearing points which extend outwardly in a star-shaped manner, wherein on the free end of each arm or bearing point is mounted a roller which is freely rotatable about an axis extending perpendicularly of the wheel plane. For each wheel with the star-shaped arms is provided in the same horizontal plane a drive wheel with arc-shaped recesses at the outer circumference thereof, wherein the recesses correspond in a positively engaging manner with the rollers. The drive wheels are for the purpose of twisting the binding wire connected to each other to perform the same movement through a common drive system which is temporarily rotated by a motor.

8 Claims, 7 Drawing Sheets

DRIVE AND BEARING DEVICE FOR THE TWISTING DISKS OF THE BINDING DEVICE OF A WASTE BALE PRESS

BACKGROUND OF THE INVENTION

1. Field of the Invention

The present invention relates to a drive and bearing device for a binding station for finished bales predominantly in waste bale presses with a horizontally acting press plate, wherein several twisting wheels provided with a radial slot for receiving the binding wire are mounted in a support and are temporarily rotated by a common drive means for the purpose of twisting the wire.

2. Description of the Related Art

Twisting stations of the above-described type with slotted twisting wheels have already been known in the art for several decades. Used as the common drive in such wheels are either revolving endless drive chains or drive gear systems which interact with corresponding external gears at the twisting wheels.

However, in the introduction of DE-OS 26 56 457 from the year 1976, it is mentioned as a significant disadvantage of these known systems, among other things, as the principal reason for interruptions of operation that the twisting wheels provided with twisting slots for receiving the binding wire and external toothings for the drive do not permit a tight encapsulation against contamination because of the free accessibility to the twisting slots. This results over time in accumulations of large amounts of dirt which finally result in the destruction of the entire gear system. However, in the reference discussed above, the only solution to solve this problem is provided by an additional component in the form of a separating push member which can be moved in and out between the press box and the press duct.

Later references, such as DE 35 44 773 C2 from the year 1985 and others of more recent date, still do not attack the problem at the root, i.e., the location of the source of the problem, but continue to use externally toothed twisting wheels in cooperation with correspondingly finely toothed drive gear wheels.

SUMMARY OF THE INVENTION

Therefore, it is the primary object of the present invention to provide, instead of the conventional gear wheel drives which are susceptible to trouble, a completely novel drive and bearing system for the slotted twisting wheels which not only provides a significant improvement with respect to the feeding of the binding wire into the slotted twisting wheels, but primarily constitutes an extremely robust support and drive concept which continues to operate without any problems even after a long period of operation and an inevitably increased contamination.

In accordance with the present invention, the drive and bearing system has the following features which cooperate with each other:

a) the wheels supporting the slotted twisting disks have a plurality of arms or bearing points which extend outwardly in a star-shaped manner, wherein on the free end of each arm or bearing point is mounted a roller which is freely rotatable about an axis extending perpendicularly of the wheel plane;

b) for each wheel with the star-shaped arms is provided in the same horizontal plane a drive wheel with arc-shaped recesses at the outer circumference thereof, wherein the recesses correspond in a positively engaging manner with the rollers;

c) the drive wheels are for the purpose of twisting the binding wire connected to each other to perform the same movement through a common drive system which is temporarily rotated by a motor.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
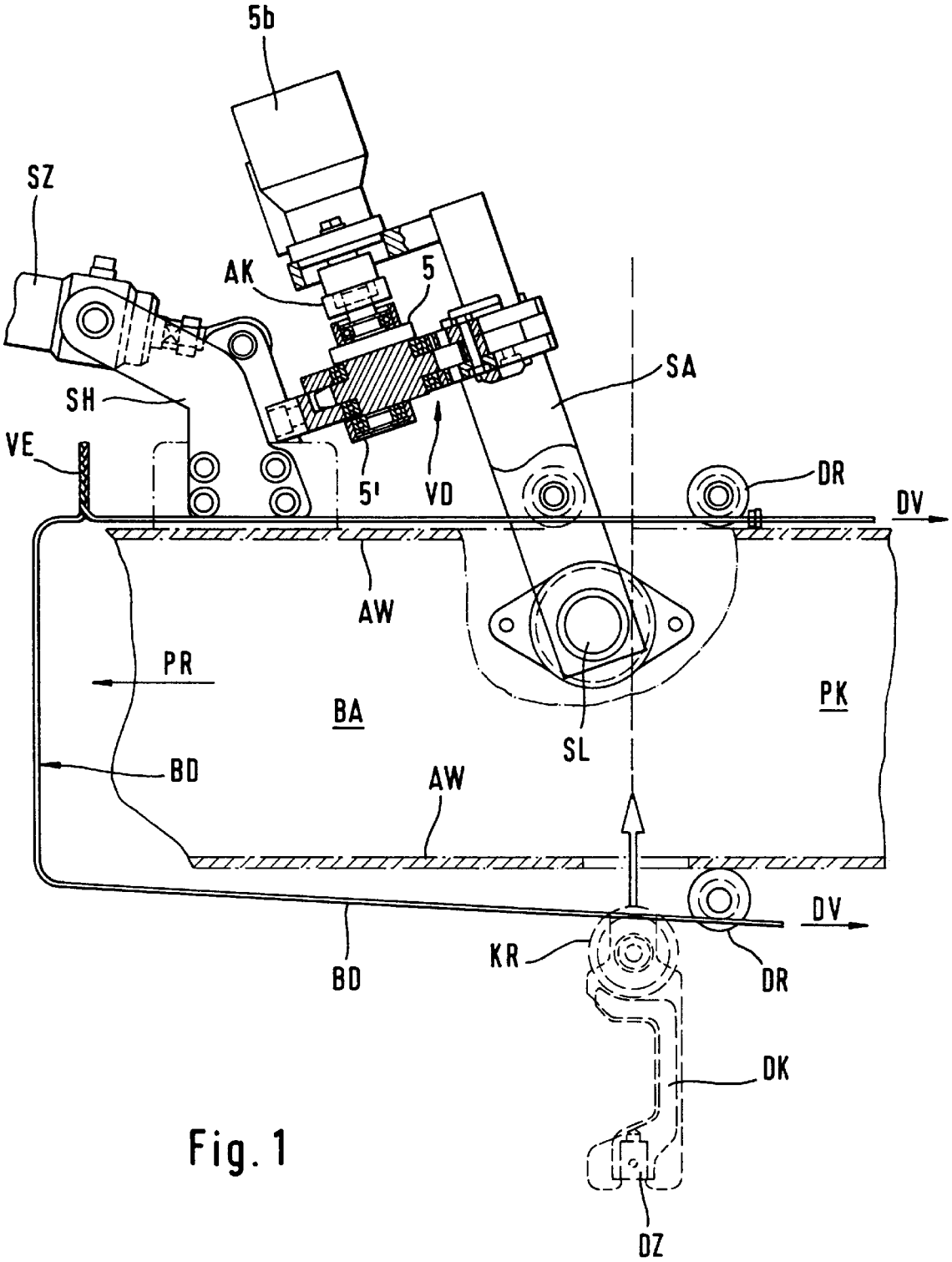
FIG. 1 is a top view of a bale press in the area of the twisting station with the twisting device in the swung-out position.
Figure 2:
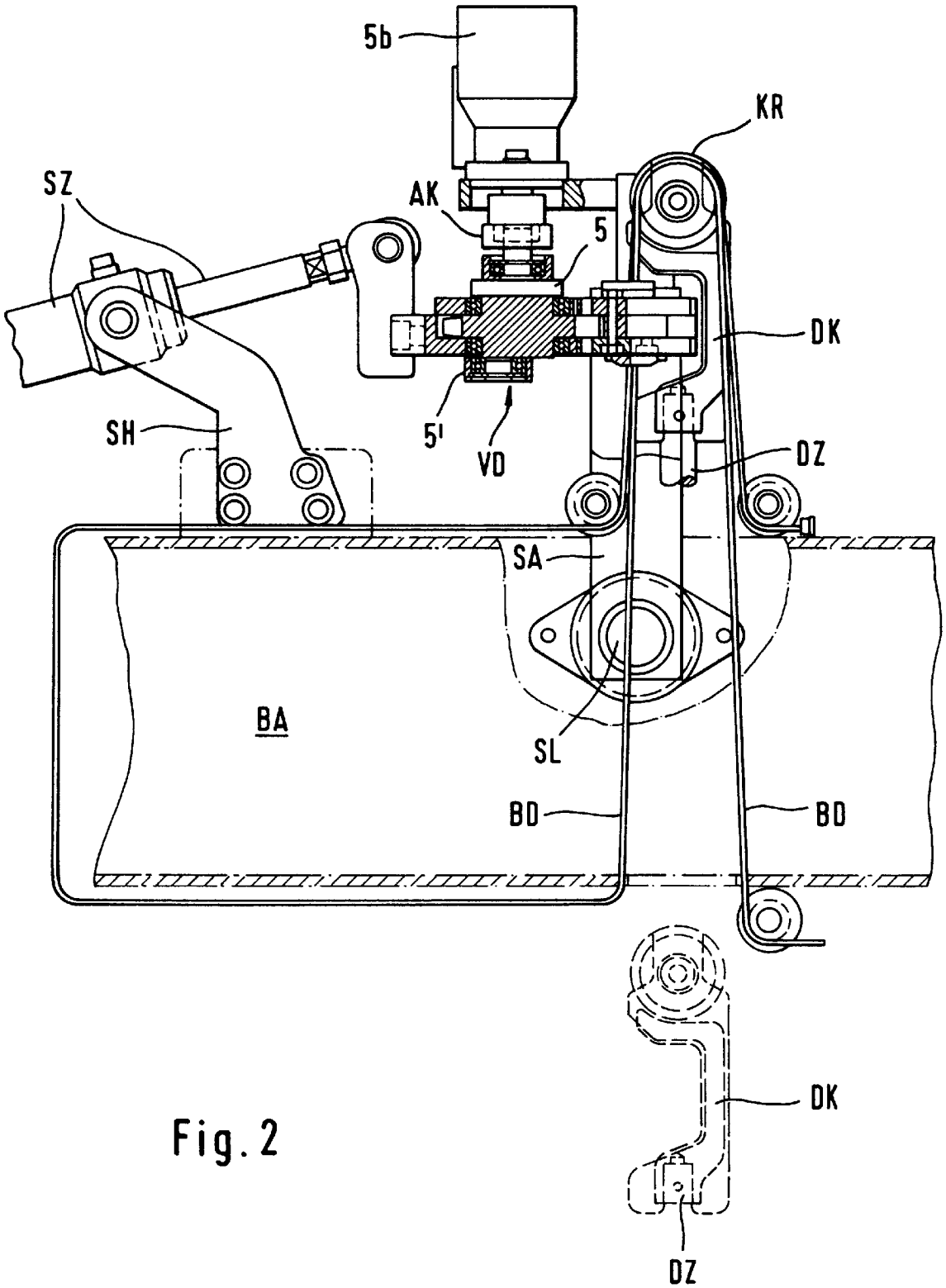
FIG. 2 is the same view as FIG. 1, with the twisting device in the position of operation.
Figure 3:
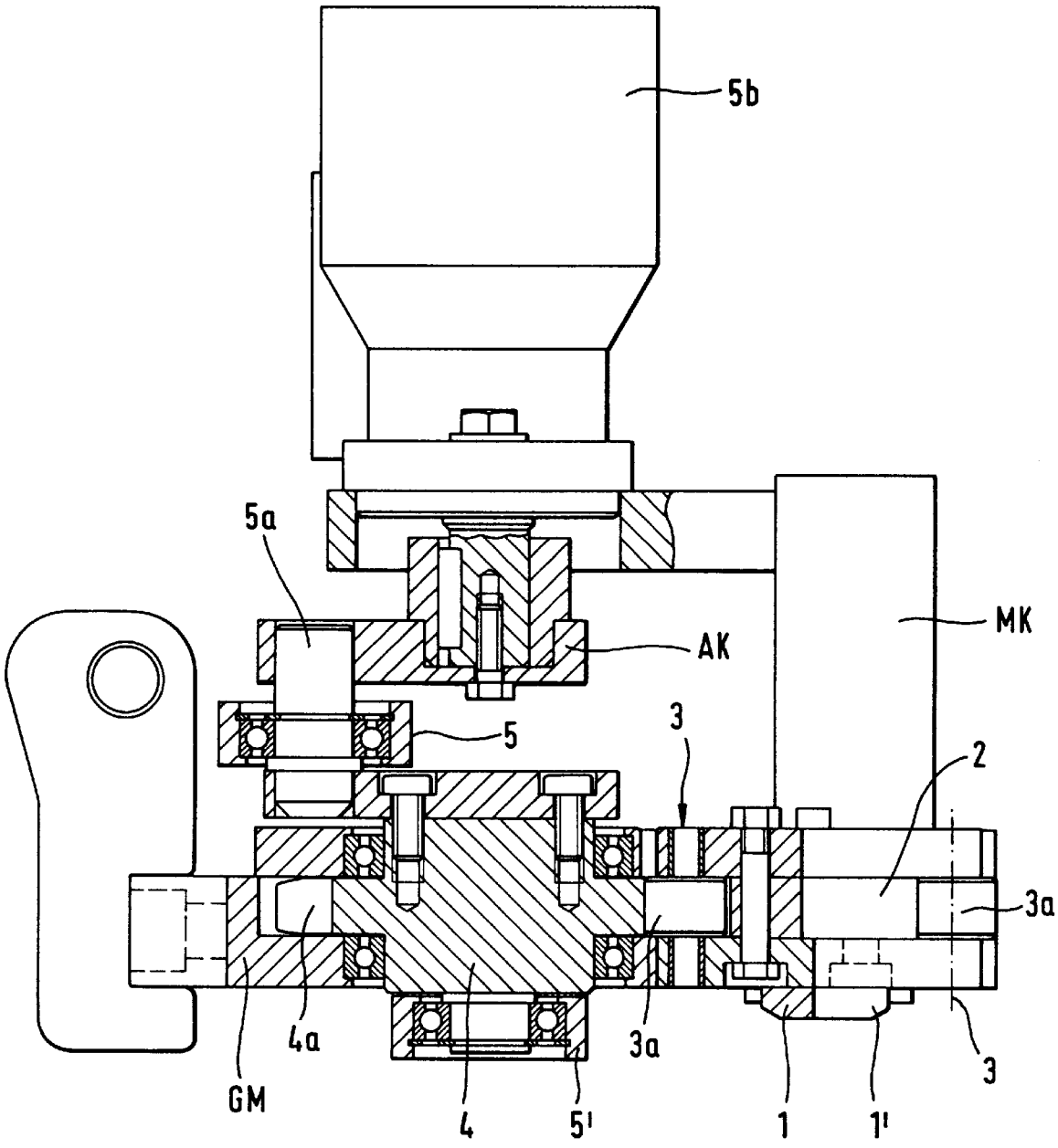
FIG. 3 is a cross-sectional view, on a larger scale, showing the twisting elements of the bale press of FIGS. 1 and 2.
Figure 4:
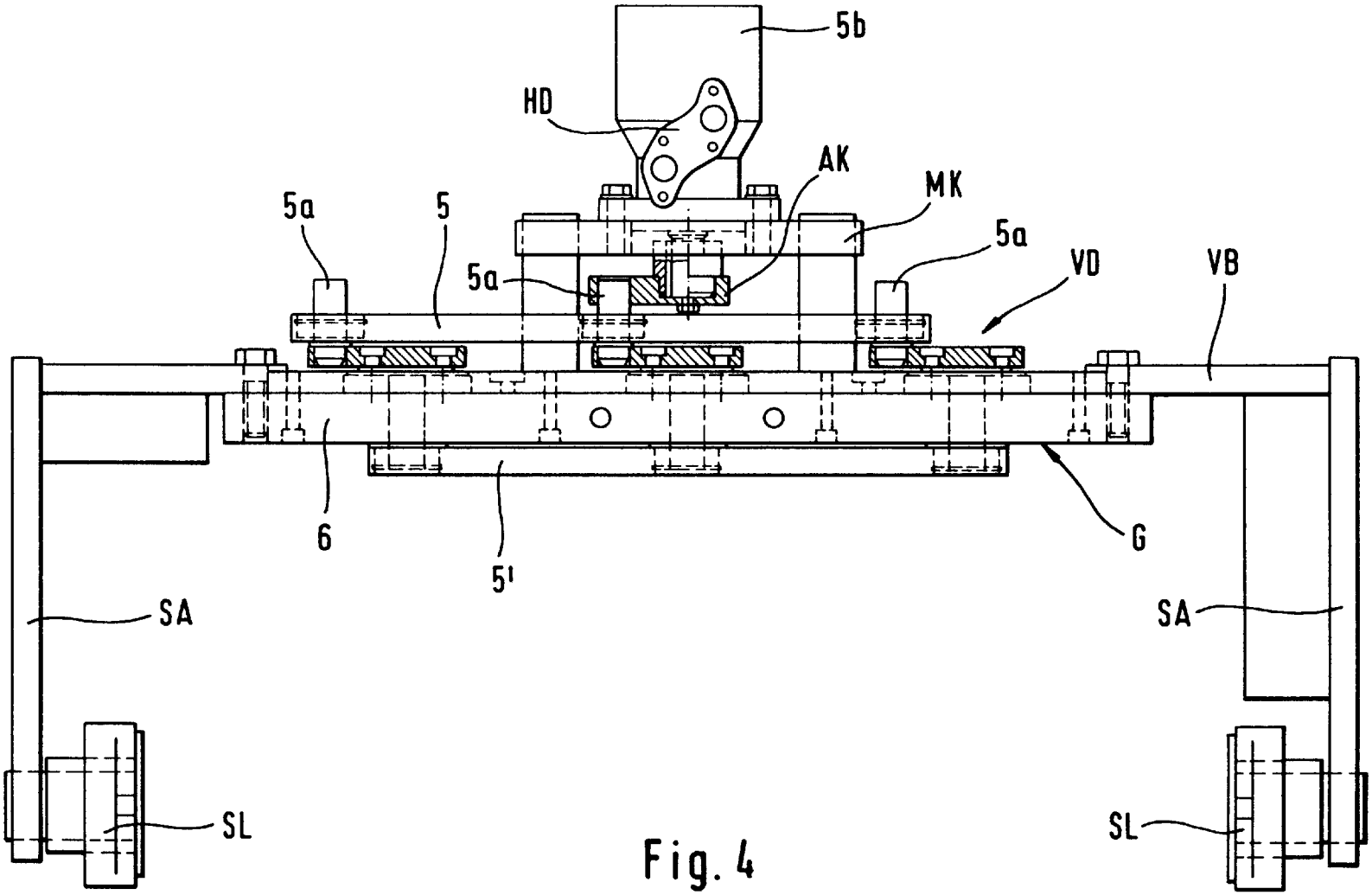
FIG. 4 is a front view, also on a larger scale, showing the entire twisting station.
Figure 5:
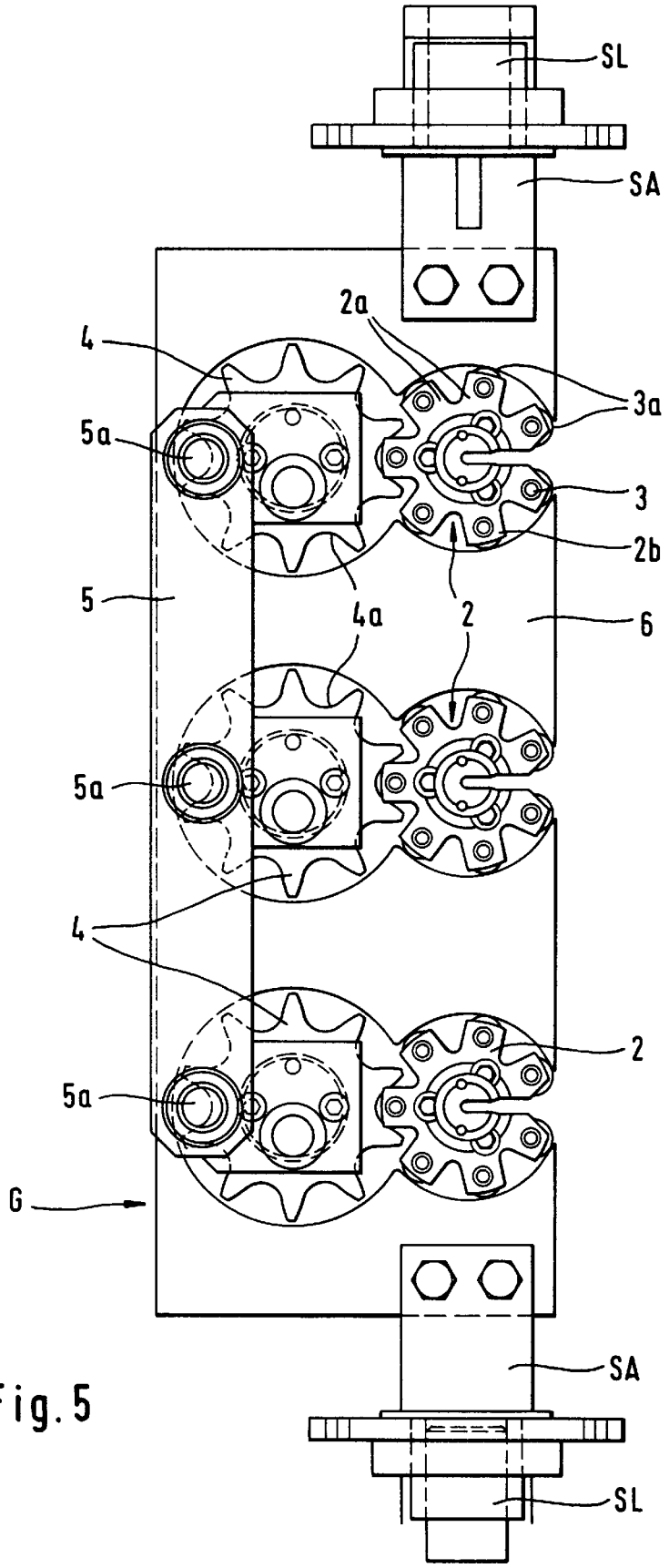
FIG. 5 is a top view of the twisting elements of the twisting station of FIG. 4.

The general structural configuration and special operation of the novel twisting device according to the present invention is illustrated in FIGS. 1 and 2 of the drawing. First of all, it is novel and structurally important that the entire twisting station VD is swung, preferably hydraulically, from its position of rest as shown in FIG. 1 into the twisting position as shown in FIG. 2 through appropriate guide arms SA which are hinged to the press housing AW.

The novel configuration of the twisting station according to the present invention which constitutes a substantial technical progress is apparent from the remaining figures of the drawing. The twisting station is in detail formed by the following interacting structural features:

a) the wheels 2 supporting the slotted twisted disks 1, 1*a* have a plurality of arms 2*a* which extend outwardly in a star-shaped manner, wherein at the free end 2*b* of each arm 2*a* is mounted a roller 3*a* which is freely rotatable about an axis 3 extending perpendicularly of the wheel plane;

b) for each wheel 2 with arms 2*a* is provided in the same horizontal plane a drive wheel 4 with arc-shaped recesses 4*a* at the outer circumference 4*b* which correspond in a positively engaging manner to the rollers 3*a;* c) the drive wheels 4, 4*a* are for the purpose of twisting the binding wire connected to each other to perform the same movement by means of a common drive system 5, 5*a*5*b* which is temporarily rotated by a motor.

The slots of the twisting disks are denoted by 1*a*.

The drive system is composed of a push crank 5, a support crank 5', a crank pin 5*a* and a drive motor 5*b*, preferably a hydraulic drive motor.

Figure 6:
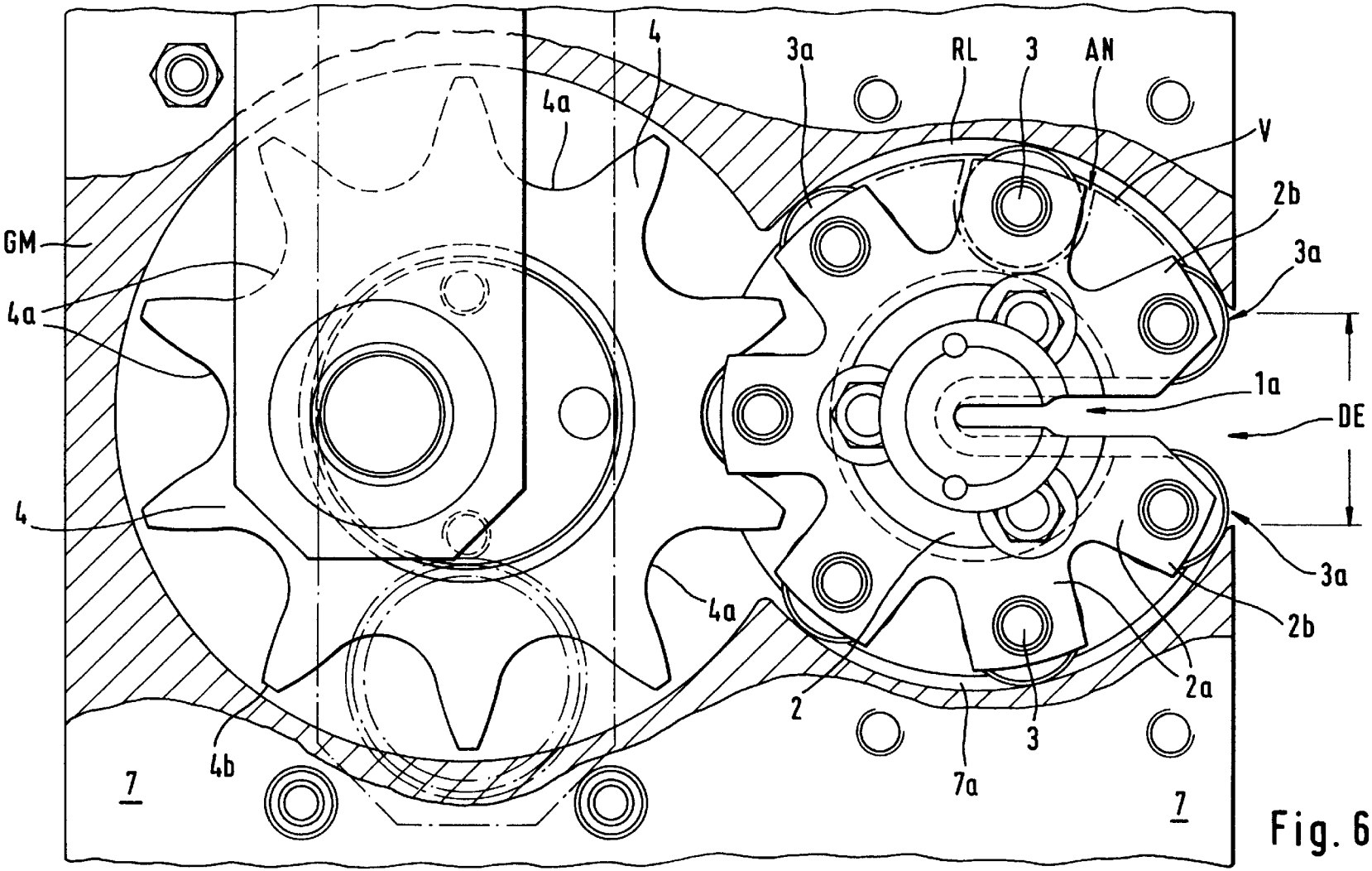
FIG. 6 is a view, on a larger scale, showing one of the twisting stations of FIG. 5 as an individual component.
Figure 7:
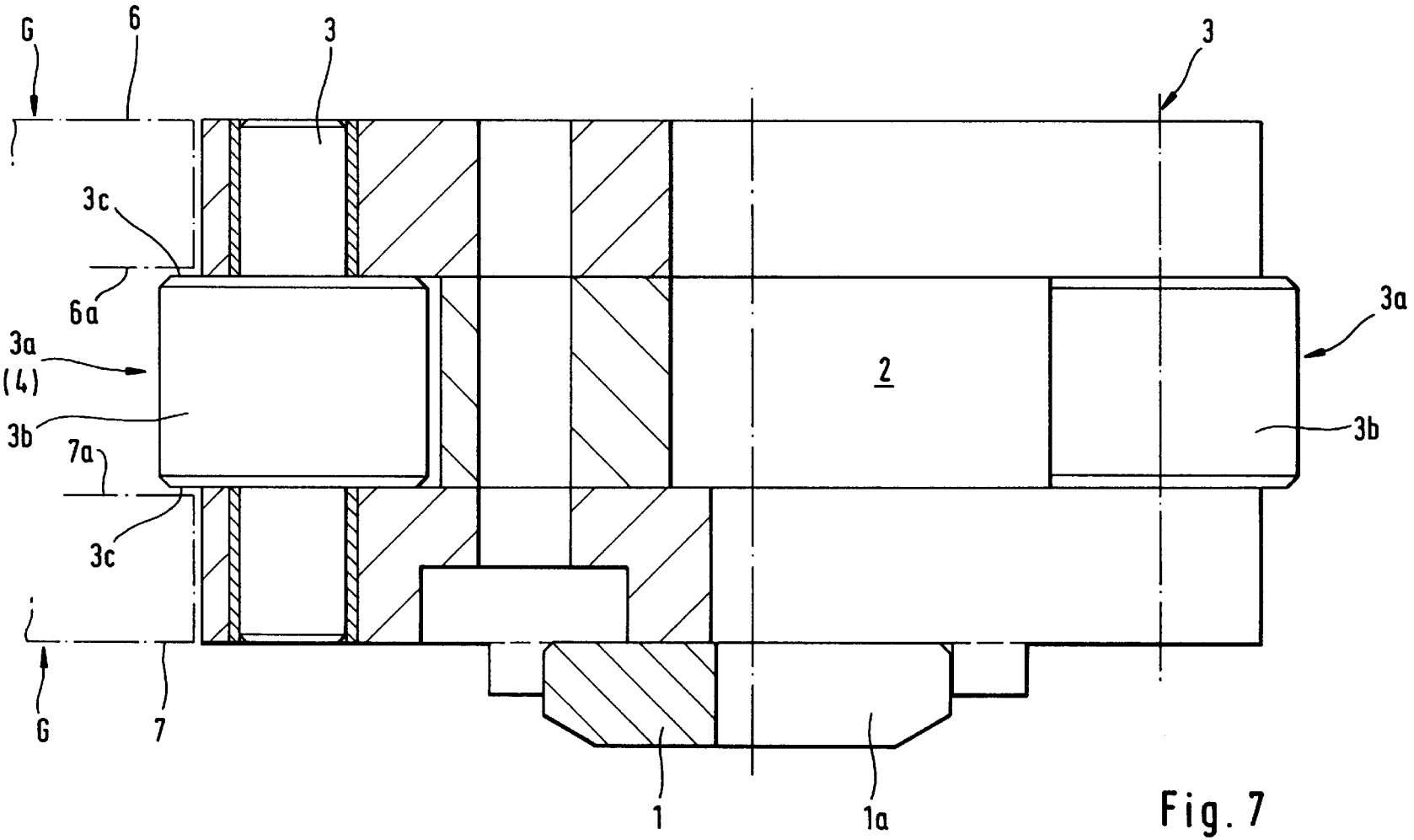
FIG. 7 shows, again on a larger scale, the detail X of FIG. 3.

In accordance with a special structural feature of the present invention, the rollers 3*a* form a cylindrical base body whose outer surface 3*b* fits together in a positively engaging manner with the recesses 4*a* of the drive wheel 4, wherein the planar end faces 3*c* of the base body serve as bearing and guiding surface in a housing G, and wherein the end faces 3*c* rest flush with sliding play against the opposing inner surfaces 6*a* and 7*a* between the base plate 6 and the cover plate 7 forming the housing G. Accordingly, the rollers and the special configuration and arrangement of the rollers causes them to be bearing and drive elements at the same time; this in a simple manner renders superfluous the gear wheel systems which were in the past susceptible to trouble with the gear wheels provided with recesses for the wire feed at the twisting disks 1 into the slots 1*c* and the divided bearing bodies. In addition, as is apparent from FIG. 6, the rollers 3*a* substantially improve the feed DE of the binding wires to be twisted into the slots 1*a* of the twisting disks 1.

In accordance with an embodiment which does not use the star-shaped arms 2*a* of the wheels 2, the wheels 2 carrying the twisting disks 1, 1*a* are rotating disks V with closed surfaces and appropriate radial recesses AN arranged in a star-like manner for mounting the bearing and guiding rollers 3–3*c*; this embodiment has the advantage that during the cutting process of the wires, the outer surface of the end face of the disk V can rest against the guide surfaces of the housing G and the rollers would not transmit the relatively high abutment forces to the guide tracks.

With respect to the drive of the twisting station VD it is advantageous as compared to the prior art if the common drive system for the synchronization and the positioning of the drive wheels 4 is formed by a push crank gear system 5, 5*a*, 5*b*, 5' which is operated, for example, hydraulically. Such gear systems are simple and robust in their construction and, thus, are extremely problem-free in their operation because practically no wear occurs even during longer periods of operation. In addition, such a system can be essentially used in a modular manner for presses with any desired number of twisting stations VD without having to construct a new wheel system, as it is required in the known gear wheel or chain wheel drives if the number of twisting disks changes; in the system according to the present invention, it is practically only necessary to replace the push crank 5.

With respect to the introduction and distribution of the force in the push crank drive according to the present invention, it is additionally an advantage if the hydraulic drive motor 5*b* of the push crank system 5, 5*a* is placed on the middle wheel 4 in the case of an odd number of wheels, for example, 3 wheels, 5 wheels, etc., and near the system middle in the case of an even number of drive wheels 4.

A drive crank AK is provided for positions 5*b* to 5.

As seen in FIG. 1, a bale BA is surrounded by binding wire BD having twisted wire ends VE.

The components for manipulating the binding wire further include a head DK for pushing through the wire, a roller DR for guiding the wire, a supply roller DV, a roller KR of the head DK and a cylinder DZ for pushing through the binding wire.

The housing G of the twisting elements has a middle portion GM.

As also illustrated in FIG. 1, the bales are being pressed in a press box PK in the pressing direction PR.

The twisting station further includes a pivoting cylinder SZ, a pivot bearing SL and a support SH for the pivot cylinder SZ and a transverse connection VB for the pivot arm SA.

The rollers 3*a* are supported by a radial track RL.

The drive motor 5*b* is connected to a motor console MK through a connecting flange HD.

While specific embodiments of the invention have been shown and described in detail to illustrate the inventive principles, it will be understood that the invention may be embodied otherwise without departing from such principles.

I claim:

1. A drive and bearing device for a binding station for finished bales in a waste bale press with a horizontally acting press plate, the binding station comprising a twisting station for twisting wires comprising a plurality of twisting disks for receiving the wires, wherein the twisting disks are mounted in a support and are configured to rotate temporarily, the twisting disks being provided with slots, the twisting station further comprising wheels for supporting the twisting disks, wherein each one of the wheels for supporting the twisting disks has a plurality of star-shaped outwardly extending arms or star-shaped-radially extending recesses, wherein on a free end of each arm or in each radially extending recess is mounted a roller so as to be freely rotatable about an axis extending perpendicularly of a wheel plane, for each wheel with star-shaped arms or star-shaped recesses, being provided in a common horizontal plane a drive wheel with arc-shaped recesses at the outer circumference thereof, wherein the recesses positively engage the rollers, the twisting station further comprising a drive system comprising a motor and configured to act on the drive wheels for temporarily rotating the twisting disks, wherein for the purpose of twisting the wires the drive wheels are connected to each other for performing the same movement through the drive system.

2. The device according to claim 1, wherein each roller has a cylindrical base body with a circumferential surface, wherein the circumferential surface engages in a positively engaging manner in the recesses of the drive wheel, wherein the base body has planar end faces forming bearing and guide surfaces in a housing.

3. The device according to claim 2, wherein the twisting station has a base plate and a cover plate forming the housing, wherein the bearing and guide surfaces are mounted so as to be located flush with sliding play against inner surfaces of the housing facing each other.

4. The device according to claim 1, wherein the wheels for supporting the twisting disks are disks with closed surfaces and wherein the radially extending recesses are arranged in the disks.

5. The device according to claim 1, wherein the bale press includes a press housing, and wherein the twisting station is pivotally mounted on the press housing.

6. The device according to claim 1, wherein the drive system for the drive wheels is comprised of a hydraulically operated push crank gear unit.

7. The device according to claim 6, wherein the motor is a hydraulic drive motor, wherein the twisting station comprises an odd number of drive wheels, and wherein the hydraulic drive motor is positioned above a middle drive wheel of the drive wheels.

8. The device according to claim 6, wherein the motor is a hydraulic drive motor, wherein the twisting station comprises an even number of drive wheels, and wherein the hydraulic drive motor is positioned above a drive wheel adjacent a middle between the drive wheels.

* * * * *